US012018667B2

(12) United States Patent
Bridgman, Jr.

(10) Patent No.: US 12,018,667 B2
(45) Date of Patent: Jun. 25, 2024

(54) AIR COMPRESSOR WITH MULTIPLE AIR TANK PRESSURE SECTIONS

(71) Applicant: Charles James Bridgman, Jr., Kettering, OH (US)

(72) Inventor: Charles James Bridgman, Jr., Kettering, OH (US)

( * ) Notice: Subject to any disclaimer, the term of this patent is extended or adjusted under 35 U.S.C. 154(b) by 50 days.

(21) Appl. No.: 17/803,460

(22) Filed: Jul. 22, 2022

(65) Prior Publication Data

US 2024/0026870 A1 Jan. 25, 2024

(51) Int. Cl.
*F04B 41/02* (2006.01)
*F04B 49/22* (2006.01)

(52) U.S. Cl.
CPC ..... *F04B 41/02* (2013.01); *F04B 49/22* (2013.01)

(58) Field of Classification Search
CPC ..... F04B 41/02; F04B 49/22; F04B 35/04
See application file for complete search history.

(56) References Cited

U.S. PATENT DOCUMENTS

| | | | | |
|---|---|---|---|---|
| 6,375,437 | B1 * | 4/2002 | Nolan | F04B 41/02 137/248 |
| 8,282,363 | B2 * | 10/2012 | Ohi | F04B 41/02 417/423.15 |
| 9,435,329 | B2 * | 9/2016 | Kitagawa | F04B 35/06 |
| 2003/0180156 | A1 * | 9/2003 | Brashears | F04B 41/02 417/234 |
| 2006/0067836 | A1 * | 3/2006 | Smith | F04B 41/02 417/234 |
| 2009/0016904 | A1 * | 1/2009 | Mannen | F04B 37/12 417/279 |
| 2010/0290929 | A1 * | 11/2010 | Ohi | F04B 41/02 417/360 |
| 2020/0340623 | A1 * | 10/2020 | Koizumi | F04D 27/004 |

* cited by examiner

*Primary Examiner* — Bob Zadeh

(57) ABSTRACT

An air compressor includes a compressor unit having a motor, a pump operably coupled to the motor and a primary tank fluidly coupled to the pump to receive pressurized air from the pump when operated by the motor. Air compressor also includes a secondary tank connected to the first tank. The secondary tank having a different air pressure than the primary tank and the air pressure in the secondary tank being controlled by fluidly connected valves to the primary tank.

4 Claims, 1 Drawing Sheet

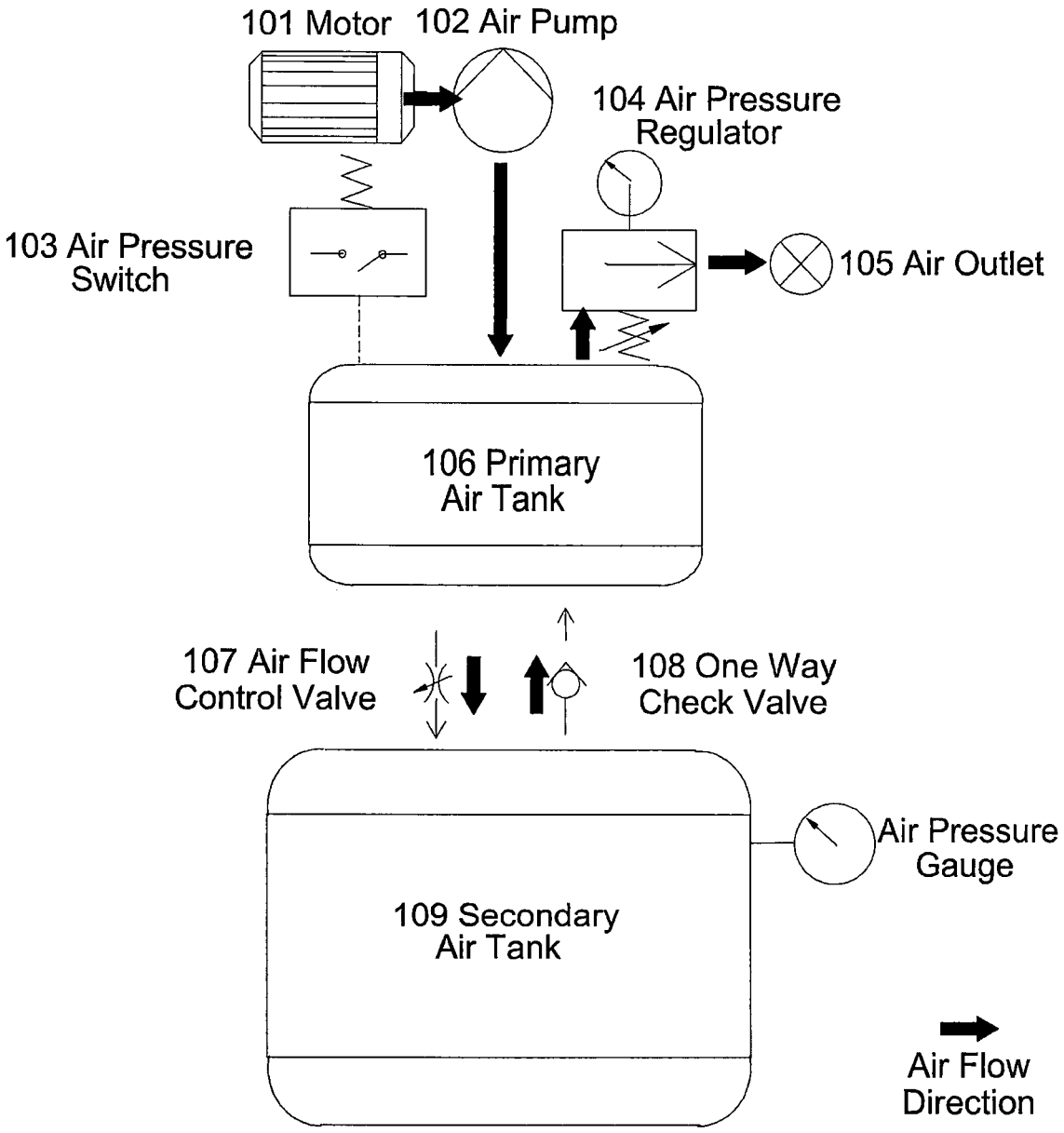
101 Motor
102 Air Pump
104 Air Pressure Regulator
103 Air Pressure Switch
105 Air Outlet
106 Primary Air Tank
107 Air Flow Control Valve
108 One Way Check Valve
Air Pressure Gauge
109 Secondary Air Tank
Air Flow Direction

AIR COMPRESSOR WITH MULTIPLE AIR TANK PRESSURE SECTIONS

CROSS-REFERENCE TO RELATED APPLICATIONS

Provisional Patent Application
No. 63/259,725
Date of filing Aug. 6, 2021

BACKGROUND OF THE INVENTION

An air compressor used for supplying high air pressure for operating air tools and other pneumatic devices, that builds high air pressure quickly and also supplies a continuous output of high air pressure.

Standard air compressors consist of a motor that drives an air compressor pump that fills a pressurized storage tank with compressed air. This compressed air in the pressurized storage tank is then used to operate pneumatic air tools such as air nailers, impact wrenches and tire inflation devices. When using such tools and devices the required air flow to power them requires a large compressed air storage tank to power them for an extended period of time. Making the compressed air storage tank large requires the air compressor pump to run for more than several minutes in order to fill the tank with an adequate air pressure to run the power tools and devices. During this start up time the air pressure is not high enough to use tools or devices. This causes an undesirable wait time before using tools.

Current market options for air compressors operating pneumatic air tools and devices are the following.

Air compressors with a small pressurized air tank that will build up working pressure for the tools quickly because of the small size of the tank but then run out of working air pressure quickly because of the small size tank.

Air compressors with large pressurized air tanks build up working pressure for the tools slowly because of the large size of the tank, but will run for a continuous length of time because of the large tank's reserve of air pressure.

BRIEF SUMMARY OF THE INVENTION

New solution of pre compressor.

What is needed is an air compressor that incorporates both the quick startup of a small pressurized tank and required reserve of high pressure air in a large pressurized tank in the same system. These two tanks allow for both a quick achieving of working air pressure and also allow for the connected pneumatic tools and devices to run for an extended time and not run out of working air pressure.

Advantage

No wasted labor time waiting for compressed air to become available.

The ability to complete a small task quickly such as inflating a tire.

The ability to have compressed air quickly when required in need of an emergency.

No waiting for working air pressure to be restored after a long period of tool use.

The savings of energy due to running the compressor for a minute as opposed to several minutes when doing small tasks.

Reduced operating hours on the compressor, extending the life cycle of the unit and reducing maintenance.

BRIEF DESCRIPTION OF THE VIEW OF THE DRAWING

FIG. 1 is a schematic design of the pre compressor.

DETAILED DESCRIPTION OF THE INVENTION

The Air Compressor With Multiple Air Tank Pressure Sections design is the following. A motor 101 of either electric or gas drives an air pump 102. The air pump 102 supplies pressurized air to the primary air tank 106. An air pressure switch 103 regulates turning off and on the motor 101 turning off or on the air pump 102. The air pressure regulator 104 is connected to the primary air tank 106 and determines the air pressure supplied to the air outlet 105 to which tools and devices are connected to. The larger secondary air tank 109 is connected to the primary air tank 106 with two air valves. The air flow control valve 107 allows pressurized air to flow from the primary tank to the secondary tank 109. This flow of pressurized air is turned off and on by adjusting the one-way port in the air flow control valve 107. The second air valve that connects the primary tank to the secondary air tank 109 is a one way check valve 108. This one way check valve 108 allows pressurized air to flow from the secondary air tank 109 back to the primary air tank 106 when air pressure is higher in the secondary tank 109 than the primary tank 107.

Flow of pressurized air through this system is the following: the air pump 102 supplies pressurized air to the primary air tank 106. Pressurized air from the primary air tank 106 flows to the secondary air tank 109 through the air flow control valve 107 when a set air pressure is reached in the primary air tank 106. The set pressure in the air flow control valve 107 is always less than the set air pressure in the air pressure switch 103. Air will continue to flow from the primary air tank 106 to the secondary air tank 109 through the air flow control valve 107 until a minimum air pressure setting is reached in the primary air tank 106. When this minimum air pressure setting is reached the air flow control valve 107 turns off stopping flow to the secondary air tank 109 allowing pressure to build up in the primary tank 107.

The continued cycling of air pressure rising and lowering in the primary air tank 106 will cycle the air flow control valve 107 off and on which in turn will build air pressure in the secondary air tank 109. When the air pressure in the secondary air tank 109 is higher than the air pressure in the primary air tank 106 the one way check valve 108 will open allowing pressurized air to flow from the secondary air tank 109 to the primary air tank 106. This flow of pressurized air from the larger secondary tank to the primary tank achieves the desired result of effectively making the smaller primary air tank 106 function with the characteristics of a larger pressurized air tank, i.e. allowing a larger flow of pressurized air out of the air compressor to the tool or device needing air pressure to operate for an extended time.

The invention claimed is:

1. An air compressor comprising:

a compressor unit including a motor having a motor housing, a pump operably coupled to the motor, the pump having a pump housing formed as a single piece with a portion of the motor housing, and a first primary air tank fluidly connected to the pump to receive pressurized air from the pump when operated by the motor; and a secondary air tank fluidly connected to the first primary air tank to receive and send the pressurized air to the first primary air tank; and wherein a fluid outlet port exiting the secondary air tank, the outlet port connected to an one way check valve, the one way check valve connected to an inlet port connected to the first primary air tank for allowing the pressurized air to flow from the secondary air tank to the first primary air tank when pressure in the secondary air tank is higher than the first primary air tank.

2. The air compressor of claim 1, further comprising: a fluid outlet port exiting the first primary air tank, and the outlet port connected to an air control valve, and the air control valve connected to an inlet port connected to the secondary air tank.

3. The air control valve of claim 2, being opened and closed controlling the pressurized air passing through the control valve to the outlet port, and into the secondary air tank.

4. The air control valve of claim 2, flow of the pressurized air into the secondary air tank is turned off and on by an air pressure switch.

* * * * *